United States Patent [19]

Ferguson

[11] Patent Number: 5,042,513

[45] Date of Patent: Aug. 27, 1991

[54] HAIR CURLING DEVICE

[76] Inventor: Keith D. Ferguson, 9105 Sugarbush, Mentor, Ohio 44060

[21] Appl. No.: 482,697

[22] Filed: Feb. 21, 1990

[51] Int. Cl.[5] ..... A45D 2/20

[52] U.S. Cl. ..... 132/247; 132/253; 132/261

[58] Field of Search ..... 132/210, 245, 246, 247, 132/248, 253, 261, 265

[56] References Cited

U.S. PATENT DOCUMENTS

| | | | |
|---|---|---|---|
| 757,241 | 4/1904 | Stone | 132/247 |
| 1,346,920 | 7/1920 | Steinacher | 132/247 |
| 2,013,258 | 9/1935 | Vecchio | 132/249 |
| 2,061,817 | 11/1936 | Van Cleef | 132/246 |
| 2,137,595 | 11/1938 | Stubbs et al. | 132/247 |
| 2,145,278 | 1/1939 | Solomon | 132/248 |
| 2,229,841 | 1/1941 | Eyraud et al. | 132/122 |
| 2,507,356 | 5/1950 | Steiner et al. | 132/247 |
| 2,557,060 | 6/1951 | Frishberg | 132/122 |
| 3,870,057 | 3/1975 | Pezzino | 132/252 |
| 4,135,525 | 1/1979 | Kriger | 132/245 |
| 4,577,647 | 3/1986 | Fenster et al. | 132/219 |
| 4,854,335 | 8/1989 | Lycett | 132/247 |

FOREIGN PATENT DOCUMENTS

| | | | |
|---|---|---|---|
| 854567 | 11/1952 | Fed. Rep. of Germany . | |
| 705559 | 6/1931 | France | 132/247 |
| 929543 | 12/1947 | France | 132/248 |
| 963852 | 7/1950 | France | 132/247 |
| 1005019 | 4/1952 | France | 132/247 |
| 410987 | 5/1934 | United Kingdom . | |

*Primary Examiner*—John J. Wilson
*Assistant Examiner*—Frank A. LaViola
*Attorney, Agent, or Firm*—Fay, Sharpe, Beall, Fagan, Minnich & McKee

[57] ABSTRACT

A hair curler for providing a variable curl on human hair is disclosed. The hair curler comprises a first elongated portion that is situated for wrapping receipt of hair. This first elongated section has a cross-sectional area A that is substantially constant over a length of the first elongated portion. A second elongated portion extends axially from the first portion and is situated for wrapping receipt of hair therearound. The second portion has a cross-sectional area B that differs from cross-sectional area A. Cross-sectional area B is substantially constant over a length of the second elongated portion of the curler.

12 Claims, 2 Drawing Sheets

HAIR CURLING DEVICE

BACKGROUND OF THE INVENTION

This invention pertains to the art of hair curlers, and more particularly to permanent wave-type hair curlers and rods. The invention is particularly applicable to curlers which provide variable curl to individual strands or locks of hair, and will be described with particular reference thereto.

Heretofore, hair curling devices have been made in a variety of configurations and materials. For example, self-contained curling units have been known. These units include rollers which have a cylindrical curling portion around which hair is wrapped, and a clamp portion that is connected to the cylindrical portion by a hinge. Once the hair is wrapped around the cylindrical portion, the clamp portion folds back upon the cylindrical portion to hold the hair and curler in place. Hair curlers having holding or clamping mechanisms separate or detached from the curling portion have also been known.

In addition, the prior art teaches flexible tube-like curling devices. Hair is wrapped around these tube-like devices, and distal ends thereof unite to form a ring which holds the hair in place. These devices are of a constant diameter which does not permit a variable curl on a lock of hair.

One problem with many of the prior art hair curlers or permanent-wave type rods is that they only provide for wrapping an individual strand or lock of hair around a cylinder of a unified diameter. As hair of length greater than about four inches is wrapped around the rod, it begins to wrap over itself. As a result, the segment of hair nearer the scalp is wrapped over a larger diameter than is the hair at the end segment. From this, it is difficult to produce a lock of hair with a curl that is as tight at the scalp as it is at the ends. Subsequently, once the hair curl begins to relax, the segment of hair near the scalp will likely loose its curl before the end segment does. Furthermore, curlers of the prior art provide a limited amount of body to hair after it has been curled with curlers of the prior art.

In an effort to provide a tighter curl near the roots and a looser curl near the ends, attempts have been made to design a rod which would vary the curl on the same strand or lock of hair. For example, cone shaped rods have been known to offer varying curl. These rods, however, have proven to be difficult to work with. Cone-shaped rods are generally longer than standard rollers, and are often comprised of rigid materials. They hang vertically when placed in the hair. Their length and rigidity make them difficult to work with.

Moreover, because cone shaped rods hang vertically, it is difficult to roll an entire head of hair without having other cones get in the way. Also, when the cone shaped rods are used to produce permanent waves, it is a challenge to be certain that all of the hair receives permanent solution and neutralizer. It is even more challenging for a hair dresser to completely rinse the solution and neutralizer from hair that is wrapped around cones.

Furthermore, because the cone is continuously decreasing in diameter, it is difficult for a hairdresser to control when to change the size of the curl of the hair strand. Cone-shaped rods have proven to be much more time consuming and difficult to work with when compared with other hair curlers of the prior art.

It would be desirable to develop a hair curler or permanent wave rod which would provide hair with a curl or permanent wave which has the potential to last for a duration greater than in the past.

It would be further desirable to develop a variable curl curling device which would be easy to work with in that it would be flexible and would not be limited to hanging vertically while wrapped on a head of hair.

It would be further desirable to develop a hair curling device which would allow a hair dresser to control the point at which a transition in curl diameter of a lock of hair takes place.

The present invention contemplates a new and improved hair curler which overcomes all of the above-referenced problems and others, and provides a variable hair curler which is simplified and allows a hair dresser to control variation in hair curl.

BRIEF DESCRIPTION OF THE INVENTION

In accordance with the present invention, there is provided a variable hair curler that is simplified in nature and provides a controlled point at which the diameter of the curl of an individual lock or strand of hair is changed.

In accordance with a more limited aspect of the invention, there is provided a hair curler that comprises a first elongated portion situated for wrapping receipt of human hair and having a cross-sectional area A. The cross-sectional area A is substantially constant over a length of the first elongated portion. The hair curler also comprises a second elongated portion that extends axially from the first portion. The second elongated portion is situated for wrapping receipt of human hair and has a cross-sectional area B that differs from cross-sectional area A. Similarly to cross-sectional area A, cross-sectional area B is substantially constant over a length of the second elongated portion.

A principal advantage of the present invention is that it provides a hair curling device having a varying diameter to permit a variable curl on the same strand of hair, with a definite transition point for controlling change in curl diameter.

Another advantage of the present invention is that it provides a hair curler which is flexible, self-contained and easy to work with.

Still other advantages and benefits of the present invention will become apparent to those skilled in the art upon a reading and understanding of the following detailed description.

BRIEF DESCRIPTION OF THE DRAWINGS

The invention may take physical form in certain parts and arrangements of parts, a preferred embodiment which will be described in detail in this specification and illustrated in the accompanying drawings which form a part hereof.

DETAILED DESCRIPTION OF THE PREFERRED AND ALTERNATIVE EMBODIMENTS

Figure 1:
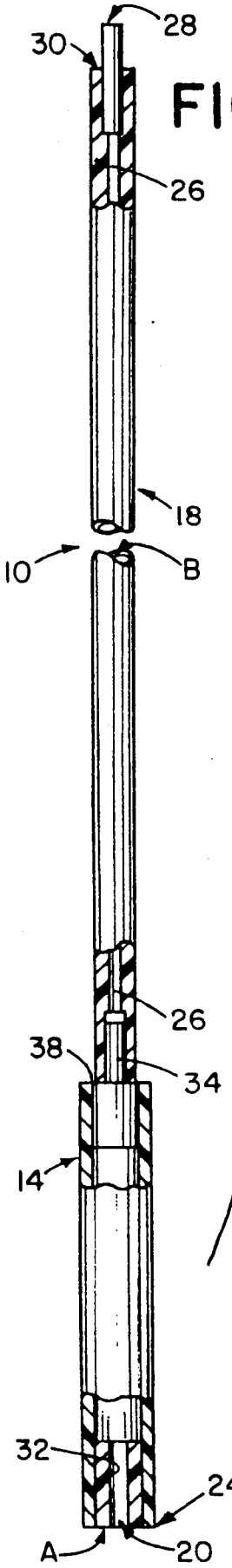
FIG. 1 is an elevational view of a hair curler of the present invention, with a portion of the curler broken away to show interior regions thereof.
Figure 3:
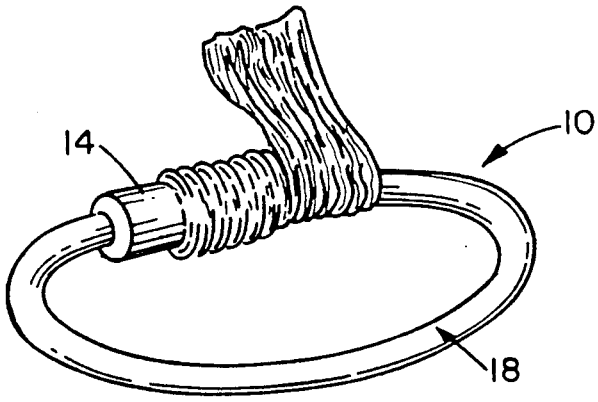
FIG. 3 shows a curler of the present invention after the hair has been wrapped therearound.
Figure 2:
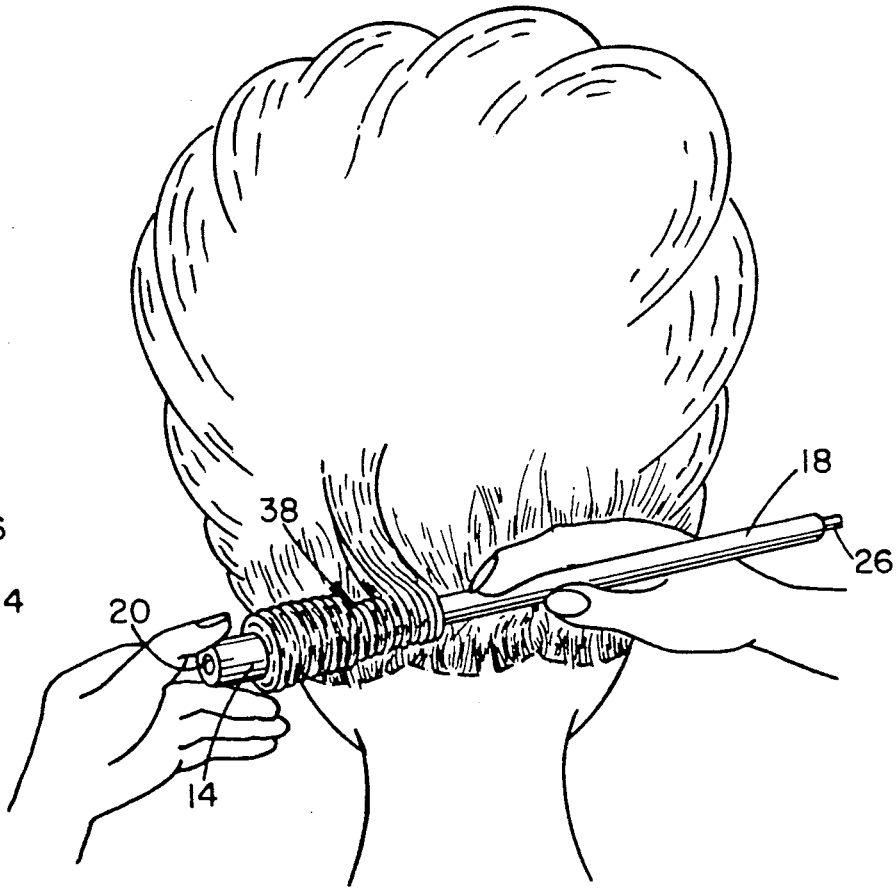
FIG. 2 shows a curler of the present invention as it is being rolled onto a lock of hair.

Referring now to the drawings wherein the showings are for purposes of illustrating preferred and alternative embodiments of the invention only and not for purposes of limiting same, FIGS. 1–3 show a hair curler or permanent rod of the present invention.

With attention first to FIG. 1, a hair curling device 10 of the present invention is shown. It will be noted that the hair curling device 10 is substantially comprised of two elongated cylindrical portions, namely the wrapping portion 14 and the link portion 18. Wrapping portion 14 is formed of a flexible material such as vinyl. It is preferably a cylindrical member which has a circular cross-sectional area A. The wrapping portion 14 defines an elongated axial bore 20 therethrough. FIG. 1 illustrates a portion of bore 20 that is adjacent terminal or distal end 24 of the wrapping portion 14.

Link portion 18, similar to wrapping portion 14, is made from a flexible material such as vinyl. Link portion 18 is cylindrical and defines a circular cross-sectional area B. Cross sectional area B is different from cross-sectional area A of wrapping portion 14, and is typically smaller than area A. The length of the link portion having the smaller cross sectional area is usually greater than the length of the wrapping portion. It is within the scope of the present invention, however, to provide a wrapping portion that is of greater length.

An elongated cylindrical axial bore 26 defined by link portion 18 extends throughout the length of link portion 18. A nipple, locking member, or protruding member 28 extends axially outward from a distal or terminal end 30 of the link portion 18. Nipple 28 is substantially cylindrical, and is of cross section suitable for selective locking telescopic receipt in opening or axial bore 20 adjacent a distal end 24 of wrapping portion 14. The flexible material of both the wrapping and link portions permit the entire hair curler to bend more than 180°, and FIG. 3 shows the curler after nipple 28 has been lockingly received by axial bore 20 to form a continuous ring.

The nipple 28 is comprised of a material that is at least slightly more rigid than both the link and wrapping portions. The nipple is of sufficient rigidity to functionally engage an inner wall 32 which defines bore 20. The relationship between the nipple and bore is akin to the relationship between a woodworker's tenon and mortise. The outer diameter of the nipple is slightly less than or substantially equivalent to the inner diameter of the bore 20. The nipple relatively easily slides into the bore, and a frictional relation between the nipple and inner wall 32 of bore 20 lockingly maintains the nipple in place in the bore.

The link portion 18 can be manually removed from the wrapping portion 14 with a minimal amount of pulling effort. As shown in FIG. 1, a second nipple 34 extends outwardly from the wrapping portion 18 and projects into the cylindrical bore 26 of link 18. The presence of nipple 34 in bore 26 provides a locking relationship between the wrapping portion and the link portion. As will be discussed below, it is not necessary that the link and wrapping portions are separable. In other words, it is foreseeable that the two portions can be integrally molded as one unit.

Once the link portion 18 is removed from the wrapping portion, the link portion can be used as a single diameter flexible tube-like rod discussed above and known in the prior art. Rigid nipple member 28 will be received into bore 26 to form a continuous ring of a constant diameter. The ease of removal of the wrapping portion from the link portion provides a versatile curler which can be used to offer a variety of hair styles. An inner diameter of wrapping portion 14 and link portion 18 is constant and defines bores 20 and 26.

Although not shown, it is within the scope of this invention to axially add additional wrapping or link portions of similar or varying diameters. The additional wrapping or link portions would require an axial bore similarly configured to those shown in FIG. 1 as 20 and 26. Further, the additional supplemental nipples similar to those denoted as 28 and 34 in FIG. 1 would be used to join additional link or wrapping portions to the existing curler shown in the Figures.

While the Figures depict the curler as being cylindrical in shape with a circular cross section, the curler could have other geometric cross sections including those defined by ellipses, ovals, octagons as well as other polygons or curvilinear shapes.

FIG. 2 shows the hair curling device 10 as it is being used to curl a lock of hair. As will be noted, the end portions of the hair are initially wrapped around the wrapping portion 14. As the wrapping of the hair subsequently approaches the scalp, the wrapping is continued onto and around the link portion 18. The step defined at 38 provides a transitional point at which the curl of the lock of hair can be varied. Accordingly, the curl achieved near the scalp is tighter than the curl near the end portion of the hair. Once the hair is securely rolled onto the hair curler 10, nipple 28 is inserted into bore 20 to form a closed ring as depicted in FIG. 3. Once proper solutions have been applied to the hair and the hair is dry, the hair is unwound from the curler, and a variable curl is provided.

As discussed above, the length of the link portion 18 is generally preferably longer than that of the wrapping portion 14. The link portion can vary from about 3 inches to about 9 inches, with a preferable range being between about 6–7 inches. The wrapping portion can range anywhere from about 1 inch to approximately 5 inches in length, with a preferred length being about 3 inches. The link portion 18 is shown to be of greater length than the wrapping portion 14 in order that a continuous ring is formed without extreme difficulty. Also, as stated above, the link portion can be used separately from the wrapping portion to provide a permanent wave to hair.

The link and wrapping portions of the curler are made of a pliable, flexible material, preferably vinyl. The nipple can be comprised of a harder plastic material which is preferably of sufficient rigidity to provide a frictional locking engagement between nipple and an inner wall 32 of wrapping portion 14.

Figure 4:
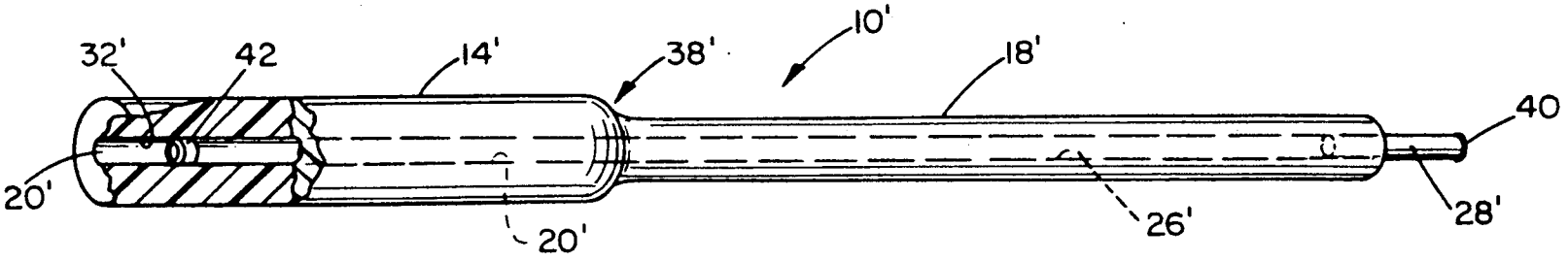
FIGS. 4–6 show alternative embodiments of the hair curler of the present invention.

FIG. 4 shows an alternate embodiment of the present invention. Like elements are denoted by like numerals bearing a single prime (′), and new elements are denoted by new numerals.

The curler 10′ shown in FIG. 4 comprises a wrapping portion 14′ and a link portion 18′ which are integrally molded as a single unit. In the curler of FIG. 4, step 38′ is tapered or eased from the wrapping portion 14′ to the link portion 18′, and the link and wrapping portions are not designed to be manually pulled apart. While the single integral structure does not offer the versatility of the preferred embodiment curler discussed above, it does provide a flexible unit which is not likely to pull apart at the step region 38'.

As will be further noted, nipple 28' includes a knob 40. The nipple is inserted into the bore until the knob is caught by the collar. When knob 40 is inserted into annular bore 20', collar 42 supplements the frictional locking relationship already present between the nipple and collar wall 32' by catching the knob and preventing it from unintentionally slipping out.

Figure 5:
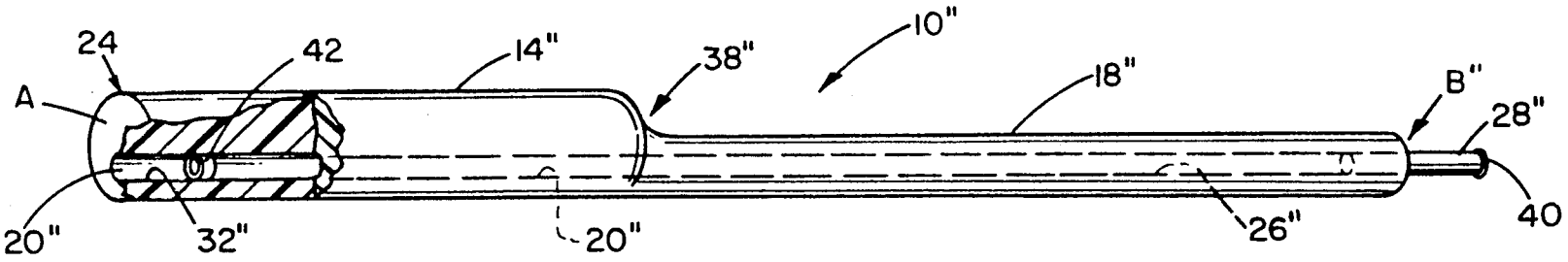

FIG. 5 shows a second alternate embodiment of the present invention. Elements which correspond to those of FIGS. 1-3 are denoted by like numerals bearing a double prime (''), and new elements are denoted by new numerals.

In FIG. 5, curler 10'' is substantially similar to the curler 10' of FIG. 4 except that the link portion 18'' does not extend outwardly from the central axis of wrapping portion 14''. Instead, the link portion extends off-center to provide a varied fit between nipple 28'' and bore 20''. Again, the nipple is shown to have a knob 40 on nipple 28'' to be lockingly received in the bore 20''. Collar 42 supplements the frictional locking engagement between nipple 28'' and inner wall 32'' of bore 20''. It is notable that the bore 20'' is not located on the central axis of the wrapping portion or the link portion, but instead is along the axis defined by the link portion 18.

Figure 6:
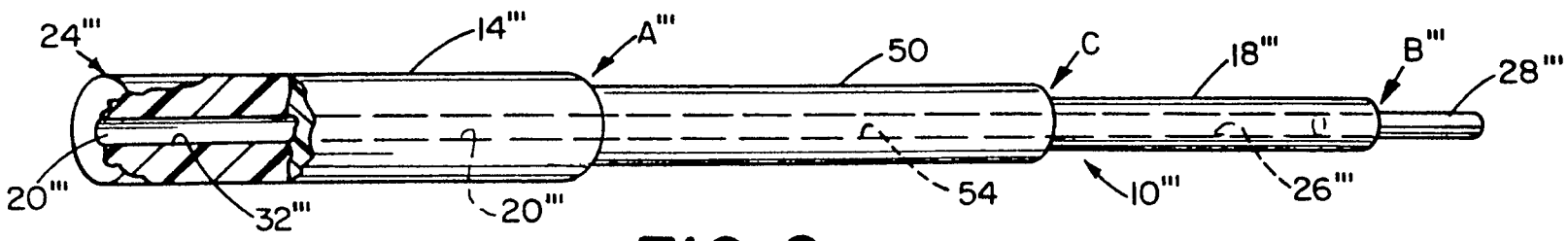

Finally, FIG. 6 shows a third alternate embodiment of the present invention. Like elements are denoted by like numerals bearing a triple prime ('''), and new elements are denoted by new letters and numerals.

In FIG. 6 wrapping portion 14''' and link portion 18''' are joined together by intermediate portion 50. The intermediate portion 50 comprises an elongated cylindrical rod of flexible material such as vinyl. A cross sectional area C of intermediate portion 50 is less than cross sectional area A''' of wrapping portion 14''', and greater than cross sectional area B''' of link portion 18'''.

Intermediate portion 50 is shown to define an axial bore 54 therethrough which is coaxial with bores 20''' and 26'''. Locking member 28''' is situated for locking receipt in a distal end of bore 20''' adjacent terminal end 24''' of curler 10'''.

Curler 10''' is defined by three coaxial cylindrical portions of varying diameter. This embodiment allows for varying the curl of long hair by three different diameters. The ends of a lock of hair are first wrapped around the wrapping portion. Next, the midsection of the lock of hair is wrapped around the intermediate portion, with the hair near the scalp finally wrapped around the link portion.

Portions 14''', 50 and 18''' can be comprised of a single integrally molded unit, or they can be removable, and joined together by additional locking members similar to nipple 28'''. As long as the central bore remains constant, it is possible to change the portions of the rods to provide a curler having a range of selectable, varying diameters.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. A hair curler, comprising:

a first elongated portion situated for wrapping receipt of hair and having a cross-sectional area A that is substantially constant over a length of said first elongated portion;

a first rigid member axially extending from a distal end of the first elongated portion;

a second elongated portion defining an axial bore suited for selective locking telescopic receipt of said first rigid member, the second elongated portion extending axially from said first portion and situated for wrapping receipt of hair, the second portion having a cross-sectional area B that differs from cross-sectional area A, cross-sectional area B being substantially constant over a length of said second elongated portion; and a second rigid member axially extending from a distal end of the second elongated portion and situated for selective locking telescopic receipt in an opening defined by said first elongated portion.

2. A hair curler, as recited in claim 1, wherein said first and second elongated portions are comprised of flexible material.

3. A hair curler, as recited in claim 2, wherein said first and second elongated portions are cylindrical.

4. A hair curler, as recited in claim 2, wherein a distal end of said first portion is situated for mating receipt of a terminal end of said second portion.

5. A hair curler, as recited in claim 4, wherein said first and second portions form a continuous loop when said terminal end is matingly received on said distal end.

6. A hair curler, as recited in claim 4, wherein the second rigid member extends from the distal end of said second portion and is situated for selective locking receipt in the opening defined by said first elongated portion to form a continuous loop.

7. A hair curler, as recited in claim 1, wherein a length of said first portion is different from a length of said second portion.

8. A hair curler, as recited in claim 1, wherein an inner diameter of said first elongated portion is the same as and coaxial with an inner diameter of said second elongated portion.

9. A process for achieving a variable curl for hair, comprising the steps of:

wrapping a first segment of a lock of hair around a first elongated portion of a hair curler, the first elongated portion having a solid outer surface and a cross-sectional area A that is substantially constant over a length of said first elongated portion, the first elongated portion defining a first axial bore therethrough and having a first rigid connecting member extending from a distal end thereof; and, subsequently wrapping a second segment of the lock of hair around a second elongated portion of the hair curler, the second elongated portion axially extending from the first elongated portion and having a solid outer surface and a cross-sectional area B that differs from cross-sectional area A, crosssectional area B being substantially constant over the length of said second elongated portion, the second elongated portion defining a second axial bore having a diameter substantially equal to that of the first axial bore, the second elongated portion having a second rigid connecting member extending from a distal end thereof.

10. A process for achieving a variable curl for hair, as recited in claim 9, further comprising the step of mating a distal end of said first elongated portion with a terminal end of said second elongated portion to form a continuous loop.

11. A process for achieving a variable curl for hair, as recited in claim 10, wherein a rigid member axially extending from the distal end of said second portion is situated for telescopic receipt in an opening defined by said first elongated portion to from a continuous loop.

12. A process for achieving a variable curl for hair, as recited in claim 9, further comprising the steps of:

unwinding the curler from the lock of human hair; and, providing a lock of hair having a variable curl.

* * * * *